United States Patent [19]

Fredd

[11] 4,230,185

[45] Oct. 28, 1980

[54] ROD OPERATED ROTARY WELL VALVE

[75] Inventor: John V. Fredd, Dallas, Tex.

[73] Assignee: Otis Engineering Corporation, Dallas, Tex.

[21] Appl. No.: 911,186

[22] Filed: May 31, 1978

[51] Int. Cl.[2] ..... E21B 43/12

[52] U.S. Cl. ..... 166/332; 166/188

[58] Field of Search ..... 166/332, 334, 323, 188; 251/315, 319, 349

[56] References Cited

U.S. PATENT DOCUMENTS

| | | | |
|---|---|---|---|
| 3,051,243 | 8/1962 | Grimmer et al. | 166/332 |
| 3,200,837 | 8/1965 | Brown | 166/323 |
| 3,351,133 | 11/1967 | Clark, Jr. et al. | 166/334 |
| 3,882,935 | 5/1975 | Calhoun | 166/323 |
| 3,886,967 | 6/1975 | Nelson | 166/323 |
| 4,051,899 | 10/1977 | Fredd | 166/332 |

*Primary Examiner*—Ernest R. Purser
*Assistant Examiner*—Richard E. Favreau
*Attorney, Agent, or Firm*—H. Mathews Garland

[57] ABSTRACT

A well valve for use in a tubing string in a well bore of an oil or gas well to isolate a lower portion of the well bore below a packer including a body having a longitudinal bore therethrough connectible in a well tubing string, a lower annular valve seat supported in the body for limited sliding movement, fluid seal means between the lower valve seat and the body, an upper annular valve seat supported in longitudinal spaced relation from the lower valve seat within the body, a ball valve member supported for rotation between opened and closed positions between the valve seats, pivot members secured with the ball valve member for rotating the valve member, and a longitudinally movable operator member coupled with the pivot members for moving the pivot members longitudinally while permitting the members to traverse an arcuate path as the ball valve member rotates between open and closed positions. The valve seals both upwardly and downwardly and is opened and closed without longitudinal travel of either seat or the ball valve member. The valve is useful in various types of well installations for production and testing procedures and is operable by manipulation of operator means coupled into the valve from an upper tubing string.

3 Claims, 8 Drawing Figures

ROD OPERATED ROTARY WELL VALVE

This invention relates to valves and more particularly relates to valves for use in tubing strings of oil and gas wells.

Wells, particularly oil and gas wells, are frequently tested and produced by techniques which require isolation of a lower portion of the well bore below well sealing apparatus such as a packer connected with a well tubing string in the well bore. In the past such well bore isolation has been accomplished by various apparatus and techniques including the use of bridge plugs one form of which is installable within a packer to provide a pressure barrier within the well bore at the packer. One form of such bridge plugs is installed from the surface in the packer and thereafter expended out the bottom of the packer to reopen the well bore. Another type of bridge plug may be retrieved to the surface after the procedures requiring the pressure barrier in the well are completed. Many of such available apparatus and techniques are costly and overly time consuming to operate and they do not permit the well to be selectively opened and closed at a downhole location without unnecessary trips into the well.

It is therefore a principal object of the invention to provide a new and improved well valve especially useful in oil and gas wells.

It is another object of the invention to provide a well valve which is connectible in the tubing string system of a well to provide a pressure barrier in the well isolating the portions of a well bore above and below a packer by manipulation of the valve by means of the tubing string above the packer.

It is another object of the invention to provide a well valve which performs the functions of an ordinary well bridge plug.

It is another object of the invention to provide a bridge plug function in a well bore which permits flow such as well fluids production through the tubing string.

It is another object of the invention to provide a well valve for the tubing string system in a well bore which effectively moves the master valve downhole in the well bore.

It is another object of the invention to provide a well valve which prevents loss of pressure from the formation opening into the well bore below a packer.

It is another object of the invention to provide a well valve which prevents drainage into the earth formation around the well bore when circulating in the well bore above the valve.

It is another object of the invention to provide a downhole well valve which will shut in the well when the tubing string above the valve is pulled. It is another object of the invention to provide a well valve which will hold pressure in either direction across the valve in a well bore.

It is another object of the invention to provide a tubing valve using upper and lower valve seats and a ball valve member which do not travel longitudinally within the valve body as the ball valve member is rotated to open and close the valve.

In accordance with the invention there is provided a well valve useful in a well tubing string including a valve body having a longitudinal bore and connectible in a well tubing string, a lower annular valve seat supported in the valve body, seal means between the valve body and the lower seat, an upper annular valve seat supported in spaced relation within the valve body from the lower valve seat, a ball valve member having a bore therethrough rotatably supported in the valve body between the valve seats for movement between a closed position at which the valve member bore is misaligned from the bore through the valve body and an open position at which the valve member bore is aligned with the bore through the valve body, a valve operator member longitudinally movable within the valve body, and pivot means coupled between the operator member and the ball valve member for rotating the ball valve member between open and closed positions. A pressure tight seal is formed between the ball valve member and the lower valve seat holding in either direction across the valve. The valve is opened and closed by longitudinal movement of the valve operator without longitudinal travel of either of the valve seats or the ball valve member.

The foregoing objects and advantages of the invention will be better understood from the following detailed description of a preferred embodiment of a well valve constructed in accordance with the invention taken in conjunction with the accompanying drawings wherein.

Figure 1:
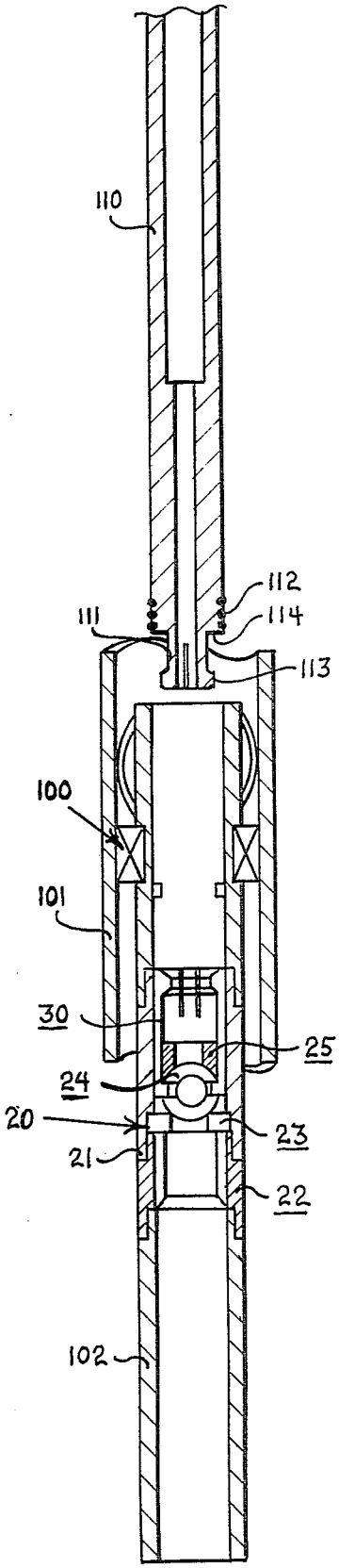
FIG. 1 is a schematic fragmentary longitudinal view in section and elevation of a well system incorporating the valve of the invention showing the valve closed and an upper tubing string positioned preparatory to insertion into the valve for opening the valve or alternatively, at a position immediately after retrieval of the string from the valve leaving the valve closed.

Referring to FIGS. 3–6, a well valve 20 embodying the features of the invention includes a valve body 21, a bottom sub 22, a lower valve seat 23, a ball valve member 24, an upper valve seat 25, a valve operator 30, and pivots 31 coupling the valve operator with the ball valve. The ball valve 24 is rotated between the closed position shown in FIG. 3 and the open position of FIG. 4 by longitudinal movement of the valve operator 30. The pivots 31 slide transversely in the valve operator while traversing an arcuate path rotating the ball valve between the open and closed positions. The lower and upper seats and the ball valve do not travel longitudinally while the valve is opened and closed by rotating the ball valve. A seal is effected between the lower seat and the ball valve sealing against a pressure differential across the valve in either direction.

The valve body 21 is internally threaded at 32 for connection on the externally threaded lower end portion of an upper tubing string 33. The valve body has an internal annular recess 34 below the threads 32 in which a ring seal 35 is disposed for sealing between the lower end portion of the tubing string 33 and the valve body. The valve body has an internal annular downwardly and inwardly sloping locking should 40, a reduced bore portion 41 below the locking shoulder, a downwardly and outwardly sloping internal annular shoulder surface 42, an enlarged bore portion 43, an internal annular downwardly facing stop shoulder 44, and a further enlarged bore portion 45 below the stop shoulder 44. The lower end portion of the valve body is internally threaded at 50 for engagement on the bottom sub 22. A ring seal 51 is disposed in an internal annular recess 52 of the bottom sub sealing between the bottom sub and the lower end portion of the valve body. The lower end portion of the bottom sub is externally threaded at 53 for connection with a lower tubing string.

The bottom sub 22 has an upwardly opening enlarged bore portion 54 defined above an internal annular upwardly facing stop shoulder 55. The bottom sub has a further reduced bore portion 60 above an internal annular stop shoulder 61. The annular lower seat 23 has an enlarged external annular portion 62 which fits in a sliding relationship in the bottom sub bore portion 54. The lower seat 23 has a further reduced portion 64 below an external annular shoulder 65 on the lower seat. The seat portion 64 slides in the bottom sub bore portion 60. A back-up ring 70 and a ring seal 71 are fitted around the lower seat portion 64 within the bottom sub bore portion 54 between the lower seat shoulder 65 and the bottom sub shoulder 55 to support the lower seat in the bottom sub and to seal between the lower seat and the bottom sub. The upper end of the lower seat 23 is provided with an internal annular spherical shaped valve seat 72 which is engageable in a sealing relationship with the spherical surface of the ball valve 24 for sealing against pressure both upwardly and downwardly. The lower seat 23 is therefore captured between the ball valve 24 and the bottom sub so that the seat is limited against longitudinal travel being permitted to move longitudinally only sufficiently to effectively form a seal at seat 72 with the ball valve.

Figure 6:
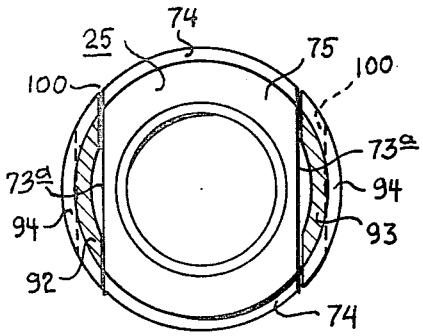
FIG. 6 is a view in section along the line 6—6 of FIG. 5.
Figure 5:
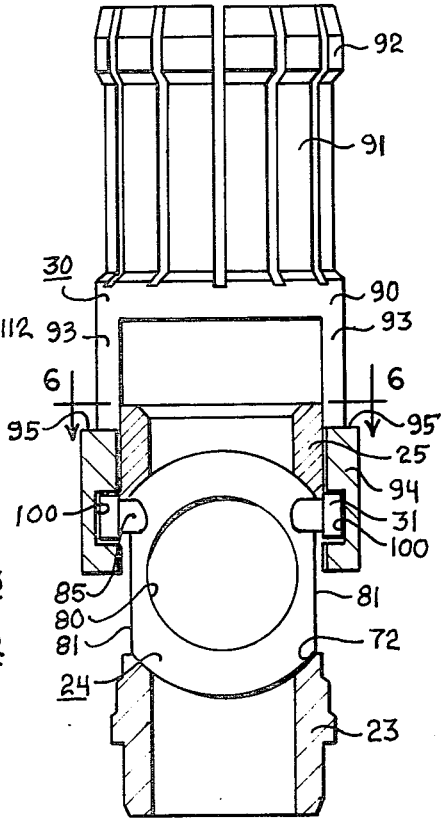
FIG. 5 is a view in section and elevation showing the principal operating parts of the valve removed from the valve body showing the ball valve member at a closed position.

The upper annular seat 25 is an annular member having an internal annular spherical seat surface 73 engageable with the spherical surface of the ball valve 24. The upper seat 25 has flat opposite side faces 73*a* and opposite external arcuate flange portions 74 extending between the side faces 73*a* as shown in FIG. 6. The arcuate flange portions 74 extend outwardly sufficiently to engage the downwardly facing internal annular stop shoulder 44 within the valve body 21 thereby holding the upper seat against upward movement in the valve body so that the upper seat is captured between the ball valve 24 and the valve body stop shoulder 44. The flange portions 74 are effectively opposite or transverse extensions of the upper end face 75 of the upper valve seat 25.

Figure 3:
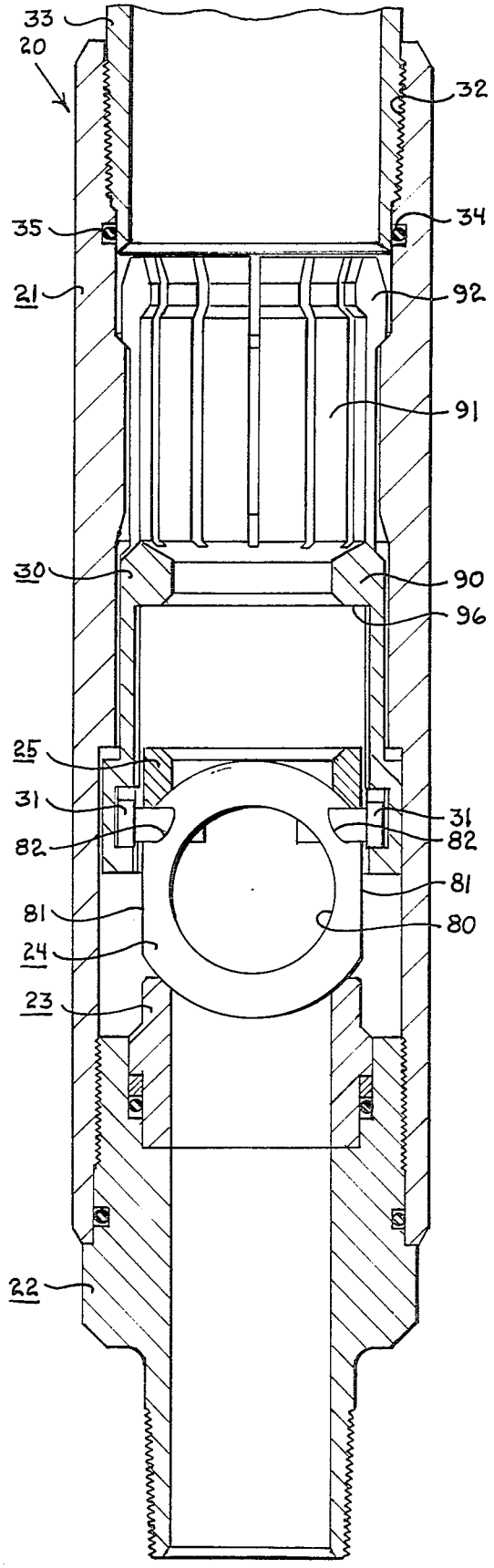
FIG. 3 is an enlarged fragmentary view in section and elevation of the well valve of the invention showing the valve closed.
Figure 4:
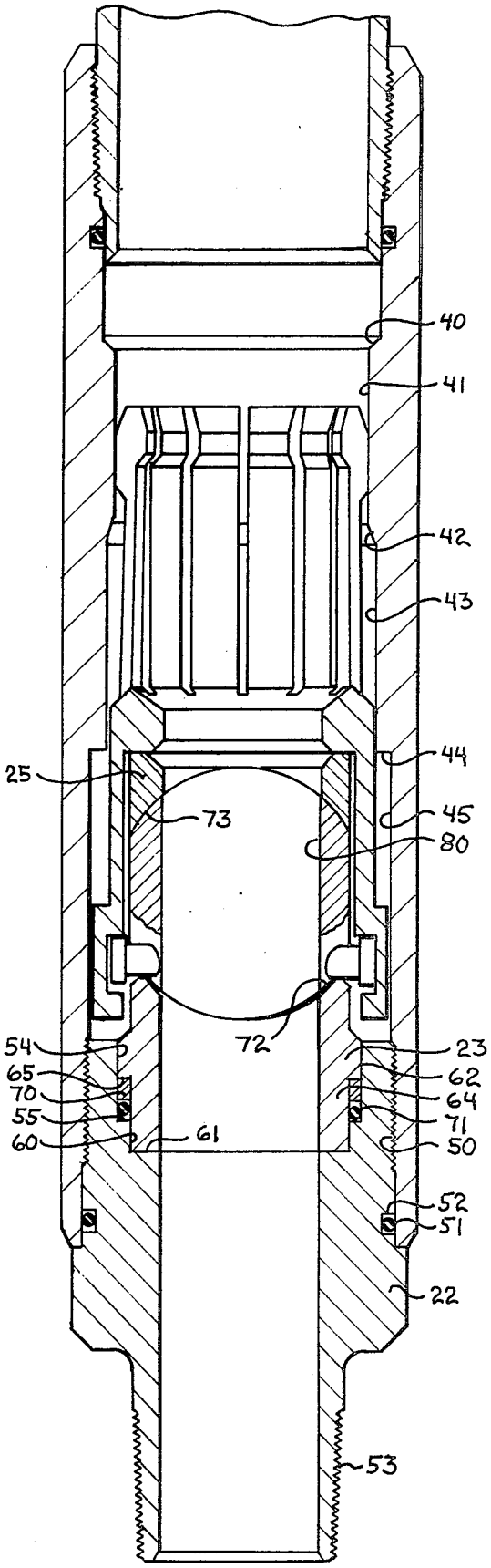
FIG. 4 is a fragmentary view in section and elevation similar to FIG. 3 showing the well valve of the invention open.

The ball valve 24 is a spherical member having a bore 80 extending entirely through the ball as evident in FIG. 4. The ball valve has flat opposite side faces 81. The ball valve 24 has pivot holes 82 extending from the opposite side faces 81 through the ball into the bore 80 for the coupling of the pivots 31 with the ball. The pivot holes 82 are positioned in the ball offset from the axis of the ball so that longitudinal movement of the pivots by the operator 30 between the positions of FIGS. 3 and 4 rotates the ball 90° from the closed position of FIG. 3 to the open position of FIG. 4. Since the ball is fixed longitudinally it rotates about the fixed axis of the ball with the holes 82 traversing a circular arc moving from the positions of FIG. 3 to that of FIG. 4.

Figure 7:
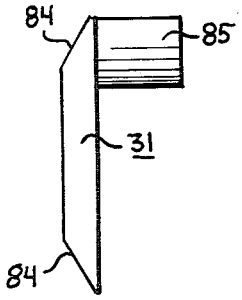
FIG. 7 is an enlarged side edge view of one of the ball valve pivots coupling the valve operator member with the ball valve member.
Figure 8:
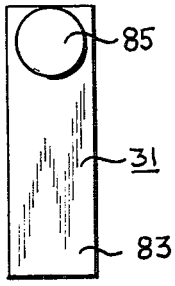
FIG. 8 is a side view in elevation as viewed from the right at 90° from the view of the pivot shown in FIG. 7.

The pivots 31 are shown in detail in FIGS. 7 and 8. Each of the pivots has a rectangular body 83 provided with tapered opposite outer end edge surfaces 84. A pivot pin 85 is formed integral with the pivot body at one end of the inside face of the body. Each of the pivot pins 85 fits within one of the pivot holes 82 of the ball valve 24. The pins are sized relative to the pivot holes to permit the ball valve to rotate relative to the pivot pins as the pivots drive the ball between the open and closed positions.

The valve operator 30 has a central ring portion 90, integral upwardly extending circumferentially spaced collet fingers 91 each having locking collet heads 92, and downwardly extending oppositely disposed operator legs 93. Each of the legs 93 is a cylindrical segment having an enlarged lower end portion 94 the upper end edge of each of which defines an upwardly facing stop shoulder 95 on each of the legs. The enlarged lower end portion 94 of each of the operator member legs has an internal transverse pivot slot 100 each of which receives the body portion 83 of one of the pivots 31 so that the pivot body may move transversely in the operator leg slot as the pivot pin tranverses the required arcuate path to rotate the ball valve between the open and closed positions. The operator legs 93 and the enlarged lower end portions 94 of the legs slide longitudinally along the side faces 73*a* of the upper valve seat 25 and the flat opposite side faces 81 of the ball valve 24 as the operator 30 is moved longitudinally to open and close the valve. In the particular arrangement of the valve as illustrated the locking collet heads 92 engage the locking surface 40 within the valve body at the upper end position of the valve operator 30 for releasably latching the valve operator at the upper valve closed position shown in FIG. 3.

Figure 2:
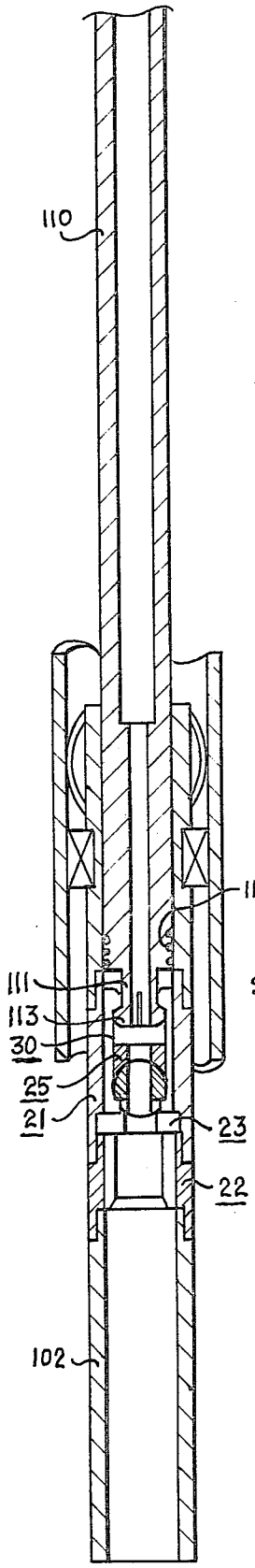
FIG. 2 is a schematic view similar to FIG. 1 showing the tubing string coupled into the valve opening the valve for well production or testing.

In a typical installation of the well valve of the invention as illustrated in FIGS. 1 and 2, the valve 20 is supported on the tubular lower end portion 33 of a standard Otis PERMA-TRIEVE Well Packer 100 as illustrated at page 3932–3935 of the 1974–75 edition of the *Composite Catalog of Oil Field Equipment and Services*, published by World Oil, Houston, Tex. The packer is installed by standard well completion procedures in the well casing 101. A string of lower well tubing 102 is supported from the lower end of the packer extending to a well producing zone, not shown, opening into the well bore below the packer. The valve 20 forms an integral part of the lower tubing string below the packer and is run with the packer when the packer is set in the well. The valve 20 is installed closed as represented in FIGS. 1 and 3 so that the well bore below the packer and valve are isolated from the well bore above the packer and valve.

In a well system equipped as illustrated in FIGS. 1 and 2, when communication from the well bore below the packer and valve to the surface is desired a string of upper tubing 110 is run from the surface. The tubing string is equipped with an operating collet 111 and external annular seals 112. The collet 111 engages and operates the operator member 30 of the well valve 20. The seals 112 form a seal between the lower end of the tubing string 110 and the packer bore. The collet 111 has locking heads 113. An operating shoulder 114 is formed on the lower end of the tubing string at the base ends of the fingers of the collet 111. As the tubing string 110 is lowered in the well bore through the packer 100 the collet 111 enters the collet fingers 91 of the well valve operator member 30. The collet heads 113 on the tubing string pass below the collet heads 92 in the valve operator. The operating shoulder 114 on the lower end of the upper tubing string engages the upper ends of the collet finger heads 92 of the valve operator. Continued lowering of the tubing string forces the valve operator 30 downwardly causing the tapered shoulder 40 within the valve body 21 to cam the collet heads 92 inwardly releasing the operator 30 to move downwardly. The collet finger heads cam inwardly around the collet 111 above the collet heads 113. The operator 30 is forced downwardly with the operator legs 92 forcing the pivots 31 downwardly so that the ball valve 24 is rotated from the closed position shown in FIG. 3 to the open position of FIG. 4. As the collet operator legs force the pivots downwardly the pivots slide transversely in the slots 100 as the pivot pins 85 must traverse a circular arc in order to turn the ball valve 24 to the open position of FIG. 4. Both the upper and lower valve seats 25 and 23 respectively remain fixed longitudinally as the valve 24 rotates about the axis of the ball valve member opening the valve. The ball valve 24 remains fixed longitudinally as it rotates. The downward stroke of the valve operator 30 is limited by the engagement of the bottom face 95 of the operator member ring 90 with the upper end edge of the upper seat 25 as shown in FIG. 4. The collet heads 92 on the valve operator move into the restricted bore portion of the valve body 21. The collet heads 92 are compressed around the collet 111 above the collet heads 113 on the collet 111. The valve 20 is thus fully open as shown in FIG. 4 with flow permitted upwardly through the valve into the tubing string 110. FIG. 2 illustrates the upper tubing string fully inserted through the packer into the well valve 20 holding the valve open so that flow may occur from the lower tubing string through the valve into the upper tubing string past the packer.

While the ball valve 20 is closed the ball valve 24 in cooperation with the lower seat 23 holds against a pressure differential across the valve from either below the valve or above the valve. A higher pressure below the valve urges the lower valve seat 23 upwardly over an annular area defined between the line of sealing of the ring seal 71 with the lower valve seat and the line of sealing between the valve seat surface 72 on the lower valve seat and the ball valve 24. If the higher pressure is above the valve the pressure acts downwardly over the closed ball valve 24 over an area defined on the ball within the line of sealing engagement between the ball and the lower valve seat surface 72 urging the ball against the lower valve seat. Thus all of the sealing occurs between the ball valve and the lower valve seat rather than with the upper valve seat 25.

When the upper tubing string 110 is retrieved upward movement of the collet heads 113 on the collet 111 engages the compressed collet heads 92 on the valve operator 30. The collet heads 113 pull the collet fingers 91 and the operator 30 of the well valve 20 upwardly rotating the ball valve 24 back to the closed position of FIG. 3 and returning the valve operator 30 to the upper end position at which the collet heads 92 expand releasing the upper tubing string collet heads 113 from the collet heads 92 so that the upper tubing string may be retrieved leaving the valve 21 closed. Due to the relationship between the compressed collet heads 92 when the valve 20 is open and the upper tubing string collet heads 113 when fully inserted into the operator member 30 below the collet heads 92, the upper tubing string cannot be retrieved without reclosing the valve 20.

Thus, the well valve 20 of the invention is operable by a removable upper tubing string so that when the upper tubing is inserted into the valve, the valve is opened and when the upper tubing string is removed from the valve, the valve is left closed. When the valve is closed the valve prevents any loss of pressure from a producing formation communicating with the well below the valve and the packer. Additionally, the closed valve prevents any drainage down through the packer and the valve from the well bore above the valve if any form of circulation involved in well treatment is occuring above the valve. Such features also readily adapt the well valve to a well system utilizing an electric pump to produce a well formation wherein such an electric pump is supported on a cable and the pump is provided with an intake tubing equipped with such features as the collet 111 and the collet heads 113 as described in connection with the upper tubing string 110. Such a pump can be lowered to the well valve and coupled with the valve to open the valve. When such a pump is retrieved the valve will be left closed.

The valve is adaptable to use with any apparatus and procedures which include the use of an insert member such as the operating collet 111 with the collet heads 113 for opening a valve when the member is inserted and for closing the valve when the member is retrieved. Numerous procedures requiring such steps where it is desirable to have the well shut in when the equipment is not connected and have the well open for flow when the equipment is connected will occur to those skilled in the production of oil and gas wells.

It will be apparent that the capability of opening the well from the surface and leaving the well closed when the opening equipment is retrieved will reduce the cost and time involved in carrying out certain well procedures. Only the longitudinal movement of the valve operator is required to open and close the valve with the ball valve member and the upper and lower seats being held against longitudinal travel within the valve body. The ability of the valve to hold against pressures above and below the valve further enhances its value in well operations.

What is claimed is:

1. A well valve comprising: a valve body having a longitudinal bore defining a flow passage therethrough including a reduced bore portion defining a locking surface and an annular tapered cam surface leading to said locking surface; a lower annular valve seat supported in said body around said flow passage spaced from said locking surface; an upper valve seat supported in said valve body around said flow passage spaced between said lower valve seat and said locking surface; a ball valve having a flow passage therethrough supported for rotation between open and closed positions about a longitudinally fixed transverse axis between said lower and upper valve seats; and a longitudinally movable valve operator in said body coupled with said ball valve for rotating said ball valve between open and closed positions responsive to longitudinal movement of said valve operator, said valve operator having a plurality of circumferentially spaced laterally flexible upwardly extending collet fingers each provided with external and internal bosses spaced from said ball valve to position said external bosses within said locking surface of said valve body bore for holding said collet fingers compressed inwardly when said ball valve is at said open position and said inner bosses on said fingers projecting inwardly to fit around an enlarged end portion of an operating probe whereby said valve is moved to said open position by insertion of said operating probe into said collet fingers and said valve is returned to said closed position upon removal of said operating probe from said collet fingers.

2. A well valve in accordance with claim 1 including annular seal means between said lower valve seat and said valve body and a line of sealing engagement between said lower valve seat and said ball valve smaller in diameter than the line of sealing between said lower valve seat and said valve body whereby upward pressure differential across said lower valve seat effects a seal between said lower valve seat and said ball valve and a downward pressure differential across said ball valve effects a seal between said ball valve and said lower valve seat.

3. A well valve for connection into the tubing string of a well to seal against a pressure differential in either direction along said tubing string across said valve and said valve being adapted to be opened and closed by insertion and removal of an operating collet having collet heads thereon, said valve comprising: a tubular valve body having connection means at opposite ends for securing said valve body in a well tubing string, a longitudinal bore defining a flow passage therethrough, and a bore portion of reduced diameter defining an internal annular locking surface along said bore and a tapered cam surface leading to said locking surface; a first annular valve seat member secured in said body around said flow passage through said body supported in sealed relationship with said body for limited longitudinal movement in said body; a second annular valve seat supported in said body around said flow passage spaced from said first valve seat and held against movement in said body in a direction away from said first valve seat; a ball valve having a bore therethrough defining a flow passage through said valve rotatably secured between said first and second valve seats for movement between open and closed positions by rotation about a substantially fixed transverse axis between said valve seats and substantially perpendicular to the longitudinal axis of said valve body; a ball valve operator member including a central annular ring, a pair of substantially parallel ball valve operator legs extending longitudinally from said central ring at opposite sides of said ring spanning opposite sides of said ball valve for longitudinal movement relative to said ball valve along lines parallel with the longitudinal axis of said valve body along paths of sufficient length to rotate said ball valve between open and closed positions responsive to longitudinal movement of said operator member, and a plurality of circumferentially spaced collet fingers extending longitudinally from said central ring of said operator member in a direction opposite from said ball valve operator legs, each of said collet fingers having an external boss and an internal boss, said external boss being engageable with said cam surface leading to said locking surface in said reduced bore portion of said valve body for holding said collet fingers inwardly when said valve operator is moved longitudinally to cam said collet fingers inwardly and position said bosses along said internal locking surface of said valve body bore, and said internal bosses of said collet fingers being engageable with the operating head on the operating collet insertable into said collet fingers for moving said ball valve operator to open and close said ball valve; and pivot members between said operator member legs and said ball valve for coupling said legs with said ball valve along opposite sides of said valve to rotate said ball valve responsive to longitudinal movement of said operator legs, said pivot members moving transversely relative to said operator legs as said ball valve is rotated between open and closed positions.

* * * * *